US007967427B2

(12) United States Patent
Ishizawa et al.

(10) Patent No.: US 7,967,427 B2
(45) Date of Patent: Jun. 28, 2011

(54) LIQUID CONTAINER

(75) Inventors: Taku Ishizawa, Matsumoto (JP); Satoshi Shinada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 854 days.

(21) Appl. No.: 11/734,100

(22) Filed: Apr. 11, 2007

(65) Prior Publication Data

US 2007/0242115 A1 Oct. 18, 2007

(30) Foreign Application Priority Data

Apr. 12, 2006 (JP) ..... P2006-110206
Mar. 30, 2007 (JP) ..... P2007-094137

(51) Int. Cl.
*B41J 2/175* (2006.01)

(52) U.S. Cl. ..... 347/86

(58) Field of Classification Search ..... None
See application file for complete search history.

(56) References Cited

U.S. PATENT DOCUMENTS

| | | | | |
|---|---|---|---|---|
| 6,183,077 | B1 * | 2/2001 | Hmelar et al. | 347/86 |
| 6,290,346 | B1 * | 9/2001 | Santhanam et al. | 347/86 |
| 6,722,762 | B2 | 4/2004 | Miyazawa | |
| 6,749,294 | B2 * | 6/2004 | Haldorsen | 347/87 |
| 6,857,732 | B2 | 2/2005 | Jones et al. | |
| 7,063,412 | B2 | 6/2006 | Jones et al. | |
| 2001/0006393 | A1 | 7/2001 | Kline et al. | |
| 2004/0070652 | A1 | 4/2004 | Haldorsen | |
| 2005/0151810 | A1 | 7/2005 | Graham et al. | |

FOREIGN PATENT DOCUMENTS

| | | | |
|---|---|---|---|
| CN | 1378915 | A | 11/2002 |
| EP | 1114724 | A | 7/2001 |
| JP | 8-90788 | A | 4/1996 |
| JP | 11-170567 | A | 6/1999 |
| JP | 2002-234178 | A | 8/2002 |
| JP | 2003-34040 | A | 2/2003 |
| JP | 2003-312014 | A | 11/2003 |
| JP | 2003-341087 | A | 12/2003 |

OTHER PUBLICATIONS

Extended European Search Report, dated Jul. 6, 2009, in European Application No. 07007507.2.

* cited by examiner

*Primary Examiner* — Omar Rojas
(74) *Attorney, Agent, or Firm* — Stroock & Stroock & Lavan LLP

(57) ABSTRACT

A liquid container detachably mountable on a liquid ejection apparatus, includes: a surface parallel to an insertion direction into the liquid ejection apparatus; and a plurality of conformity identification protrusions integrally formed at the surface to be in parallel to the insertion direction for preventing erroneous insertion of the liquid container to a container mounting portion due to a difference in shape of the conformity identification protrusions, wherein each of the conformity identification protrusions has a different length from a contact portion located at one end in the insertion direction to a reference surface located at the other end in the insertion direction.

8 Claims, 10 Drawing Sheets

LIQUID CONTAINER

BACKGROUND

1. Technical Field

The present invention relates to a liquid container that has an erroneous insertion prevention mechanism for preventing erroneous insertion into a container mounting portion of a liquid ejection apparatus.

2. Related Art

In a color ink jet type printer (liquid ejection apparatus) that performs color printing, ink cartridges (liquid containers) as exclusive-use containers, in which ink of different colors of B (black), C (cyan), M (magenta), and Y (yellow) are filled, respectively, are used. Ink (liquid) filled in the individual ink cartridges are supplied to a printing head that is driven according to print data transmitted from a host computer and is then ejected at a target position on a printed matter, such as a paper or the like, through nozzles of the respective colors provided in the printing head.

In recent years, in order to realize high-definition full color printing, color ink that is mounted on a printer includes intermediate colors of DY (dark yellow) or LC (light cyan), in addition to C (cyan), M (magenta), and Y (yellow) Then, the number of ink cartridges that are mounted on one printer increases.

An exclusive-use cartridge mounting portion (container mounting portion) for each color is provided in the printer. However, when the ink cartridges having the same exterior size are used for the respective colors, the similar cartridge mounting portions are also arranged, and thus a user may mistake a mounting position.

When an ink cartridge is mounted at an erroneous color position, ink around an ink supply port of the cartridge and ink of a different color remaining around an ink supply needle of the printer may be mixed with each other. Accordingly, print quality may be degraded.

Further, when a plurality of ink cartridges that substantially have the same exterior and contain different kinds of ink (for example, dye or pigment) are manufactured, a pigment printer and parts of the pigment printer can be shared. However, since the ink cartridges that substantially have the same shape and contain different kinds of ink are sold, an ink cartridge of an erroneous ink kind may be inserted into the printer. If a pigment ink cartridge is erroneously inserted into the pigment printer, pigment ink around an ink supply port of the ink cartridge and pigment ink remaining around an ink supply needle of the printer may be mixed with each other. Then, the pigment may be aggregated and clogging may occur in the head.

In addition, when a plurality of ink cartridges that have substantially the same exterior and contain different filling amounts of ink are manufactured, in a printer that is expected to perform printing in small quantity, a cheap and small-capacity ink cartridge can be provided. Further, in a printer that is expected to perform printing in large quantity, a large-capacity ink cartridge can be provided with a low unit cost per 1 g of ink. However, since the ink cartridges that substantially have the same shape but different capacities are sold, an ink cartridge having an erroneous capacity may be inserted into the printer. If a small-capacity ink cartridge is inserted into a large-capacity printer, even it ink is exhausted, printing may be continuously performed, and thus the head may break down. To the contrary, if a large-capacity ink cartridge is inserted into a small-capacity printer, even if ink still remains, ink end may be judged, and thus a large quantity of ink may remain.

Accordingly, there is suggested a technology that selectively provides identification convex portions (or concave portions) at a plurality of positions defined in a partial region of the carriage as an erroneous insertion prevention mechanism, which prevents an ink cartridge from being erroneously inserted into an unconformable different cartridge mounting portion (for example, see Patent Documents 1 to 5).

Patent Document 1: JP-A-2003-34040
Patent Document 2: JP-A-2002-234178
Patent Document 3: JP-A-11-170567
Patent Document 4: JP-A-2003-341087
Patent Document 5: JP-A-8-90788

As described above, the number of ink cartridges having similar shapes increases, and thus the erroneous insertion prevention mechanism needs to be structured to identify a larger number of kinds of ink cartridges.

As the number of kinds of ink cartridges to be identified increases, the size of the erroneous insertion prevention mechanism becomes large. Then, the volume of an ink containing chamber of the cartridge may be pressed. Further, the structure for identification may be complicated, and manufacturing costs may be increased.

SUMMARY

An advantage of some aspects of the invention is to provide a liquid container that can form a large number of completely incompatible patterns in a small space with easy design and simple structure, without enlarging and complicating the structure of an erroneous insertion prevention mechanism. The advantage can be attained by at least one of the following aspects:

A first aspect of the invention provides a liquid container detachably mountable on a liquid ejection apparatus, comprising: a surface parallel to an insertion direction into the liquid ejection apparatus; and a plurality of conformity identification protrusions integrally formed at the surface to be in parallel to the insertion direction for preventing erroneous insertion of the liquid container to a container mounting portion due to a difference in shape of the conformity identification protrusions, wherein each of the conformity identification protrusions has a different length from a contact portion located at one end in the insertion direction to a reference surface located at the other end in the insertion direction.

According to the liquid container having the above-described configuration, each of the conformity identification protrusions has a different length from the contact portion located at one end in the insertion direction to the reference surface located at the other end in the insertion direction. Accordingly, a large number of completely incompatible patterns can be formed in a small space with easy design and simple structure, without enlarging and complicating the structure of an erroneous insertion prevention mechanism.

Moreover, the term 'completely incompatible' used herein indicates that an arbitrary liquid container can be inserted at only a regular mounting position in a regular liquid ejection apparatus and that only a regular liquid container can be inserted at an arbitrary mounting position in an arbitrary liquid ejection apparatus.

In the liquid container according to the first aspect of the invention, the conformity identification protrusions may be arranged at a regular pitch in a widthwise direction perpendicular to the insertion direction.

According to the liquid container having the above-described configuration, the conformity identification protrusions are arranged at a regular pitch in the widthwise direction perpendicular to the insertion direction. Therefore, the conformity identification protrusions can be formed even in a small space to have the same width, and thus uniform manufacturing accuracy can be achieved.

As a result, degradation of manufacturing accuracy when the width of an arbitrary conformity identification protrusion is increased while the width of another conformity identification protrusion is decreased, that is, degradation of erroneous insertion detection accuracy can be prevented.

When the width of any conformity identification protrusion is set to a minimum value required for securing hardness, if other conformity identification protrusions are formed to have the same width, the patterns can be formed a requisite minimum space.

Since the conformity identification protrusions are arranged at the regular pitches, the shapes can be simplified and useless complication can be avoided.

In the liquid container according to the first aspect of the invention, the difference in the lengths of the conformity identification protrusions may have a regular pitch.

According to the liquid container having the above-described configuration, when an erroneous liquid container is inserted at a mounting position, a position where the liquid container cannot be inserted due to unconformity of the conformity identification protrusion can be set to a regular pitch. At this time, the erroneous liquid container that can be inserted deepest cannot be inserted by the smallest pitch from the regular mounting position.

Therefore, when a pitch is set to a requisite minimum value, if other pitches are set to the same value, the patterns can be formed in a requisite minimum space. Moreover, the requisite minimum value is set to such a value that a user can recognize erroneous insertion.

Since the conformity identification protrusions are arranged at the regular pitches, the shapes can be simplified and useless complication can be avoided.

In the liquid container according to the first aspect of the invention, a mark that corresponds to the difference in shape of the conformity identification protrusions maybe integrally molded at the surface.

According to the liquid container having the above-described configuration, the mark corresponding to the difference in shape of the conformity identification protrusions is integrally molded at the one surface, and a mark corresponding to the ink kind (liquid kind) is granted simultaneously with assembling of the liquid container. Therefore, a work that grants a mark later can be omitted, thereby realizing work saving. In addition, erroneous display can be reliably prevented.

Further, an assembling worker can easily identify, through the mark, the ink kind that is rarely grasped only with the shape corresponding to the ink kind, that is, the shape of the erroneous insertion prevention mechanism. Therefore, erroneous assembling can be reliably prevented.

In the liquid container according to the first aspect of the invention, the conformity identification protrusion may have a shape corresponding to a kind of the liquid, the liquid container may further comprise a different conformity identification protrusion that is different from the conformity identification protrusion and has a shape corresponding to a capacity of a liquid, and the liquid container may be configured by a first member having the different conformity identification protrusion and a second member having the conformity identification member.

According to the liquid container having the above-described configuration, the shape corresponding to the liquid capacity is provided in the first member, and the shape corresponding to the liquid kind is provided in the second member. Therefore, the number of kinds of parts is suppressed to the sum of the number of kinds of liquid capacities and the number of ink kinds (the number of kinds of liquid capacities+ the number of liquid kinds). As a result, manufacturing costs of molds or management costs of parts can be reduced.

A second aspect of the invention provides a liquid container detachably mountable on a liquid ejection apparatus, comprising: a surface parallel to an insertion direction into the liquid ejection apparatus; and a plurality of first identification members formed at the surface for preventing erroneous insertion of the liquid container to a container mounting portion due to a difference in shape of the first identification members, wherein each of the first identification members has a different length from a contact portion located at one end in the insertion direction to a reference surface located at the other end in the insertion direction; and wherein the first identification member is a groove recessed from the surface.

According to the liquid container having the above-described configuration, each of the first identification members has a different length from the contact portion located at one end in the insertion direction to the reference surface located at the other end in the insertion direction. Accordingly, a large number of completely incompatible patterns can be formed in a small space with easy design and simple structure, without enlarging and complicating the structure of an erroneous insertion prevention mechanism.

In the liquid container according to the second aspect of the invention, the first identification members may be arranged at a regular pitch in a widthwise direction perpendicular to the insertion direction.

In the liquid container according to the second aspect of the invention, the difference in the lengths of the first identification members may have a regular pitch.

In the liquid container according to the second aspect of the invention, a mark that corresponds to the difference in shape of the first identification members may be integrally molded at the surface.

In the liquid container according to the second aspect of the invention, each of the first identification members may have a shape corresponding to a kind of a liquid stored in the liquid container.

In the liquid container according to the second aspect of the invention, the liquid container may further comprise a second identification member that has a shape corresponding to a capacity of a liquid stored in the liquid container.

In the liquid container according to the second aspect of the invention, the liquid container may further comprise a second identification member that has a shape corresponding to a capacity of a liquid stored in the liquid container, the liquid container may be configured by a first member having the second identification member and a second member having the first identification member.

According to the liquid containers of the invention, each of the conformity identification protrusions or first identification members has a different length from the contact portion located at one end in the insertion direction to the reference surface located at the other end in the insertion direction. Therefore, a large number of completely incompatible patterns can be formed with easy design and simple structure, without enlarging and complicating the structure of the erroneous insertion prevention mechanism. As a result, manufacturing costs of the liquid container can be reduced.

The present disclosure relates to the subject matter contained in Japanese patent application No. 2006-110206 filed on Apr. 12, 2007, which is expressly incorporated herein by reference in its entirety.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of a liquid container according to the invention will be described in detail with reference to the accompanying drawings.

Figure 1:
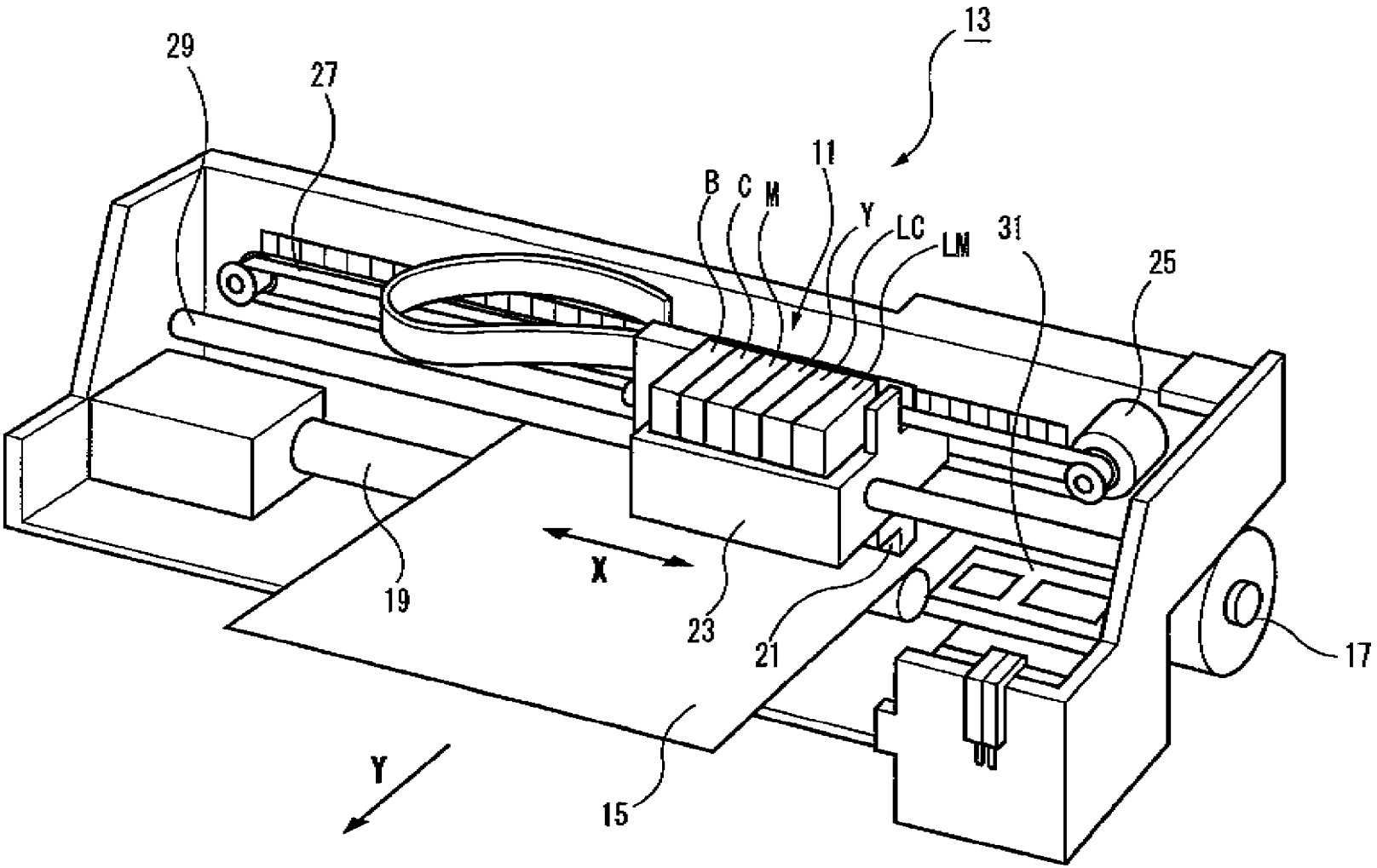
FIG. 1 is an exterior perspective view of a liquid ejection apparatus on which a liquid container according to an embodiment of the invention is mounted.
Figure 4:
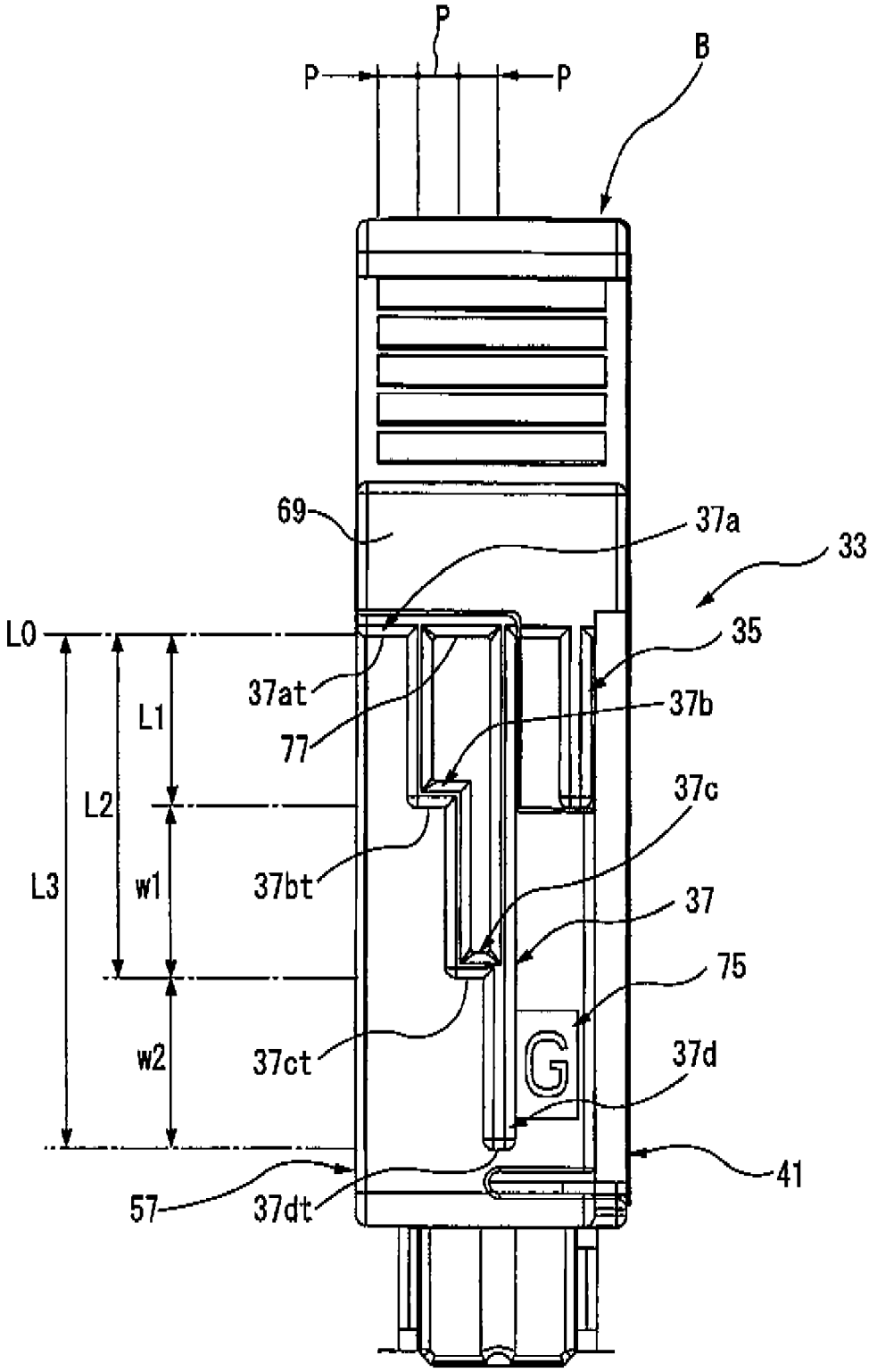
FIG. 4 is a rear view of an ink cartridge shown in FIG. 3.
Figure 5:
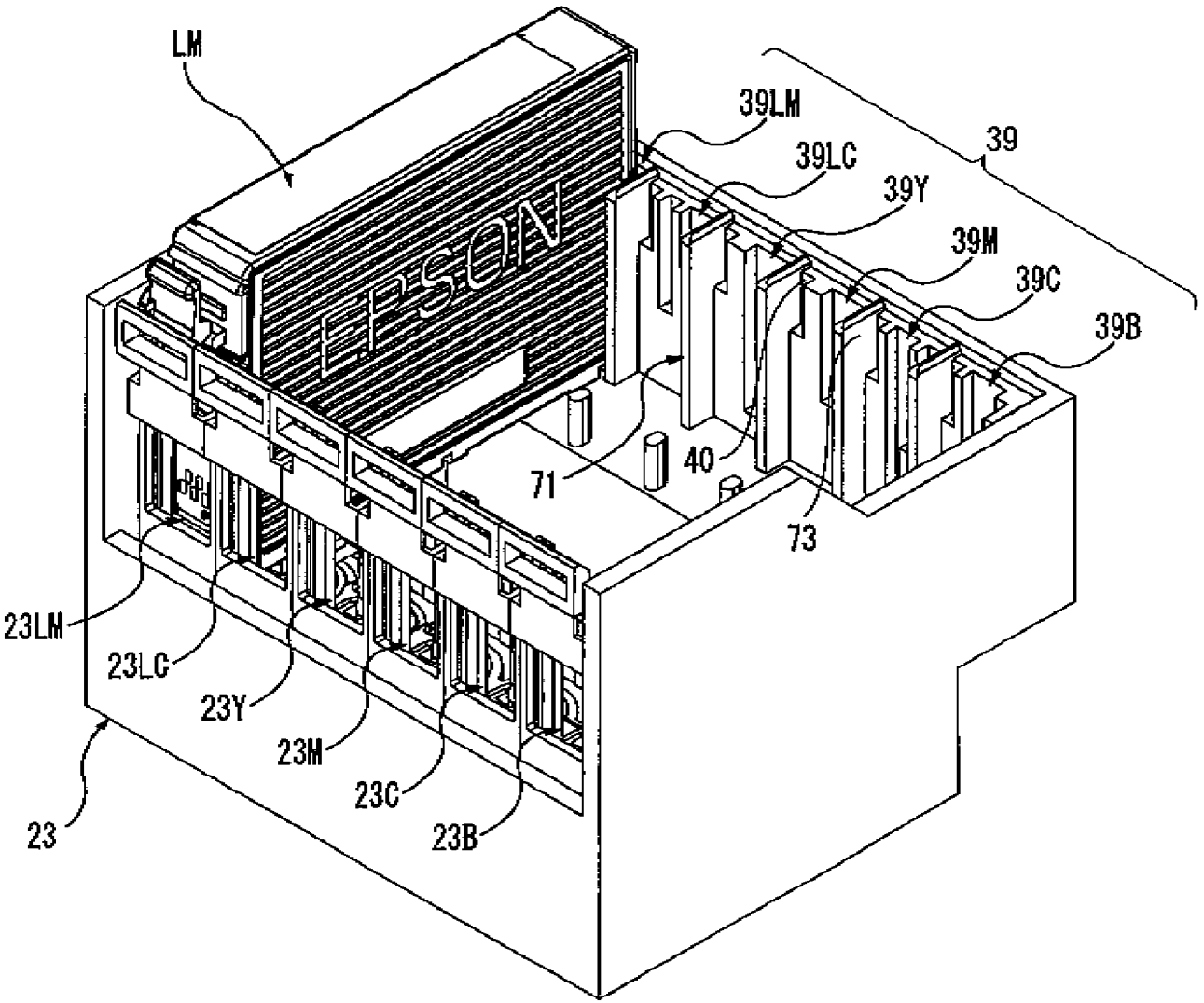
FIG. 5 is a perspective view showing a state where only one ink cartridge is mounted on a carriage shown in FIG. 1.
Figure 6A:
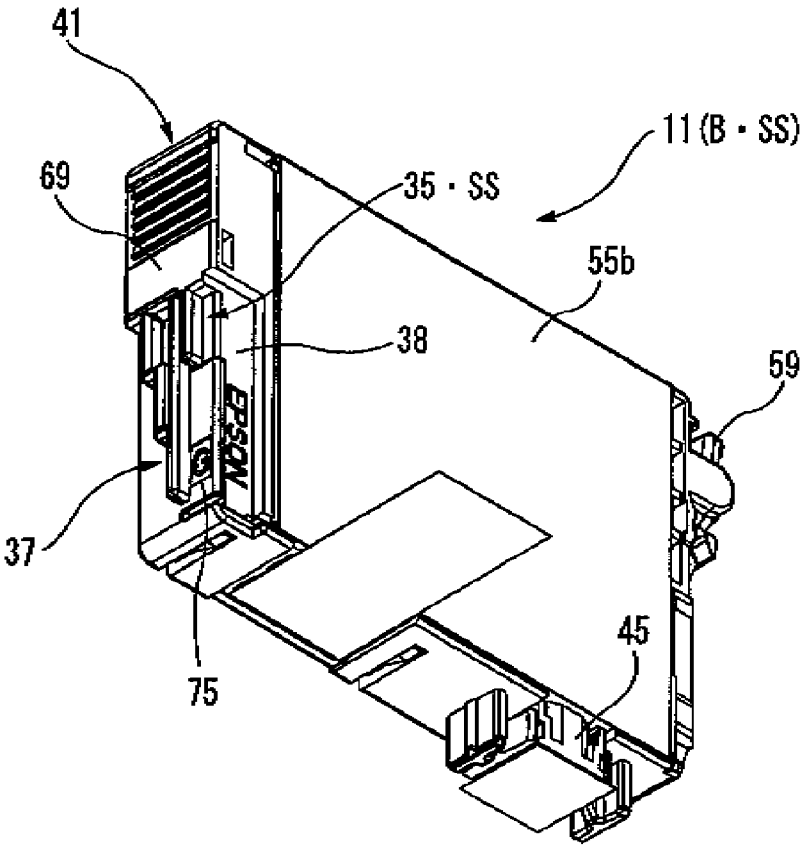
FIGS. 6A and 6B are perspective views of liquid containers having different capacities.
Figure 6B:
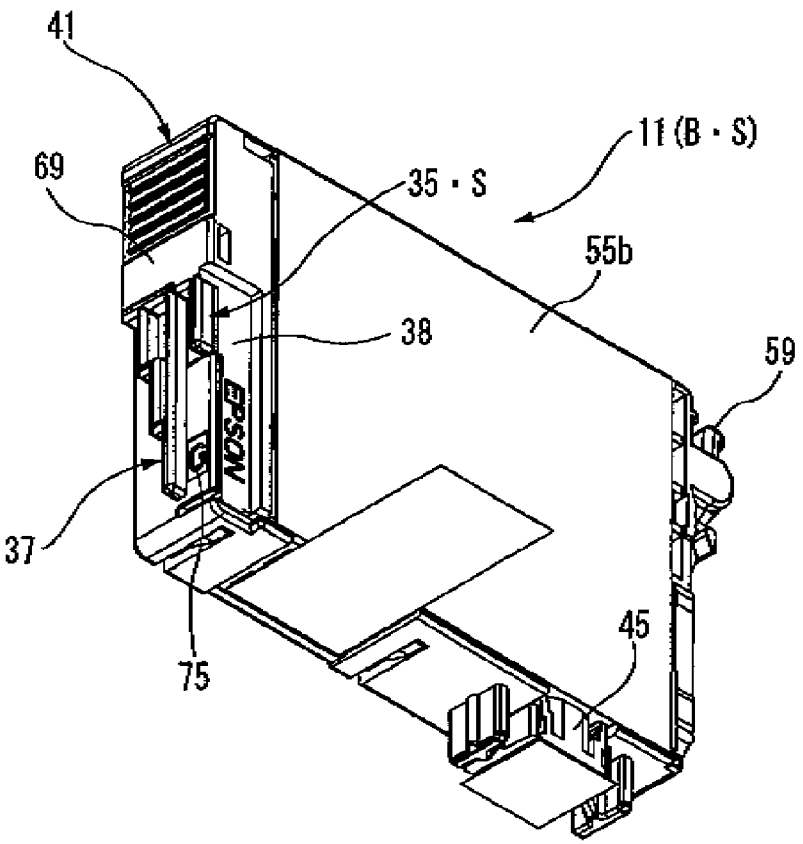
Figure 7:
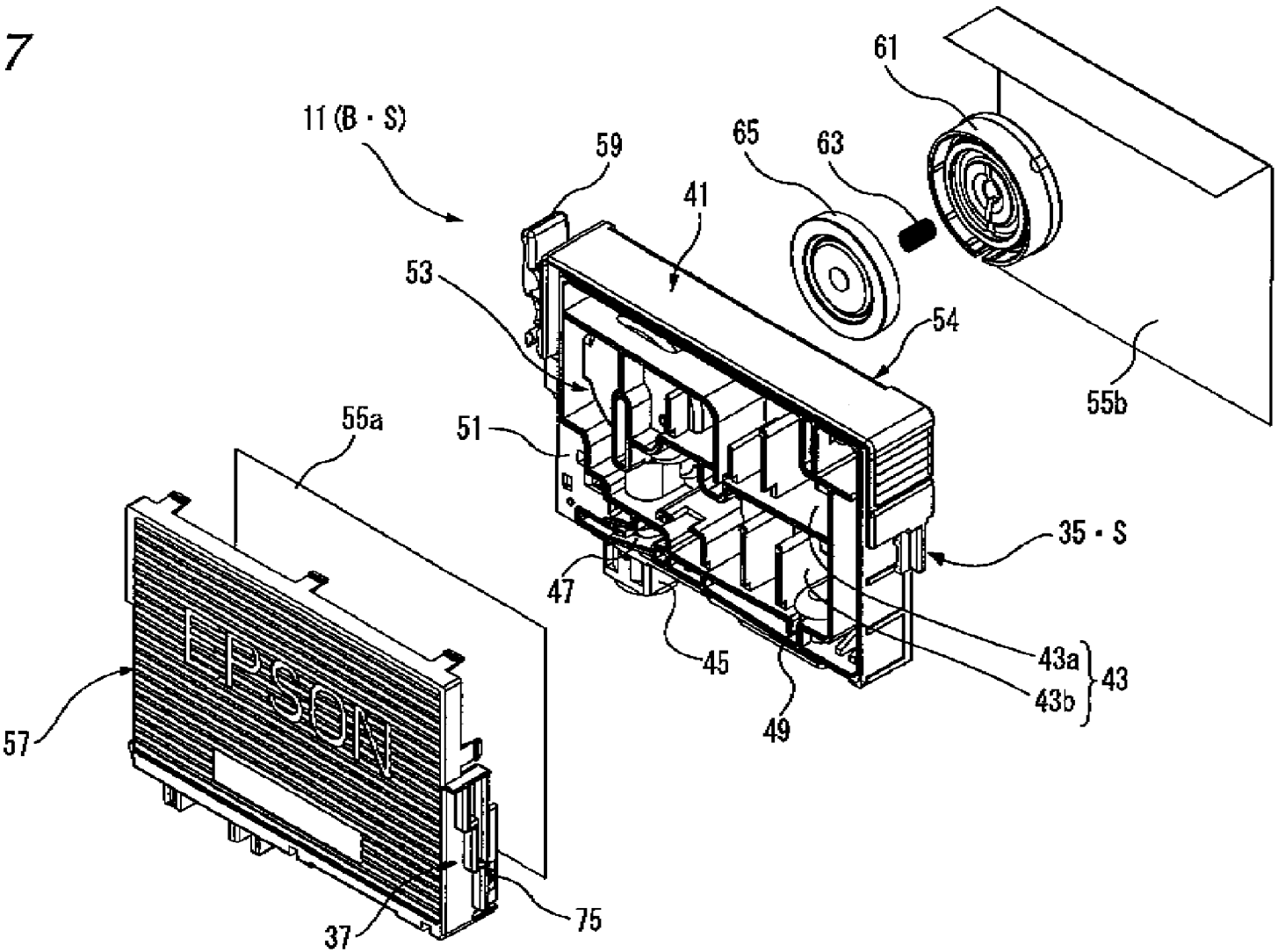
FIG. 7 is an exploded perspective view of a large-capacity liquid container.
Figure 8:
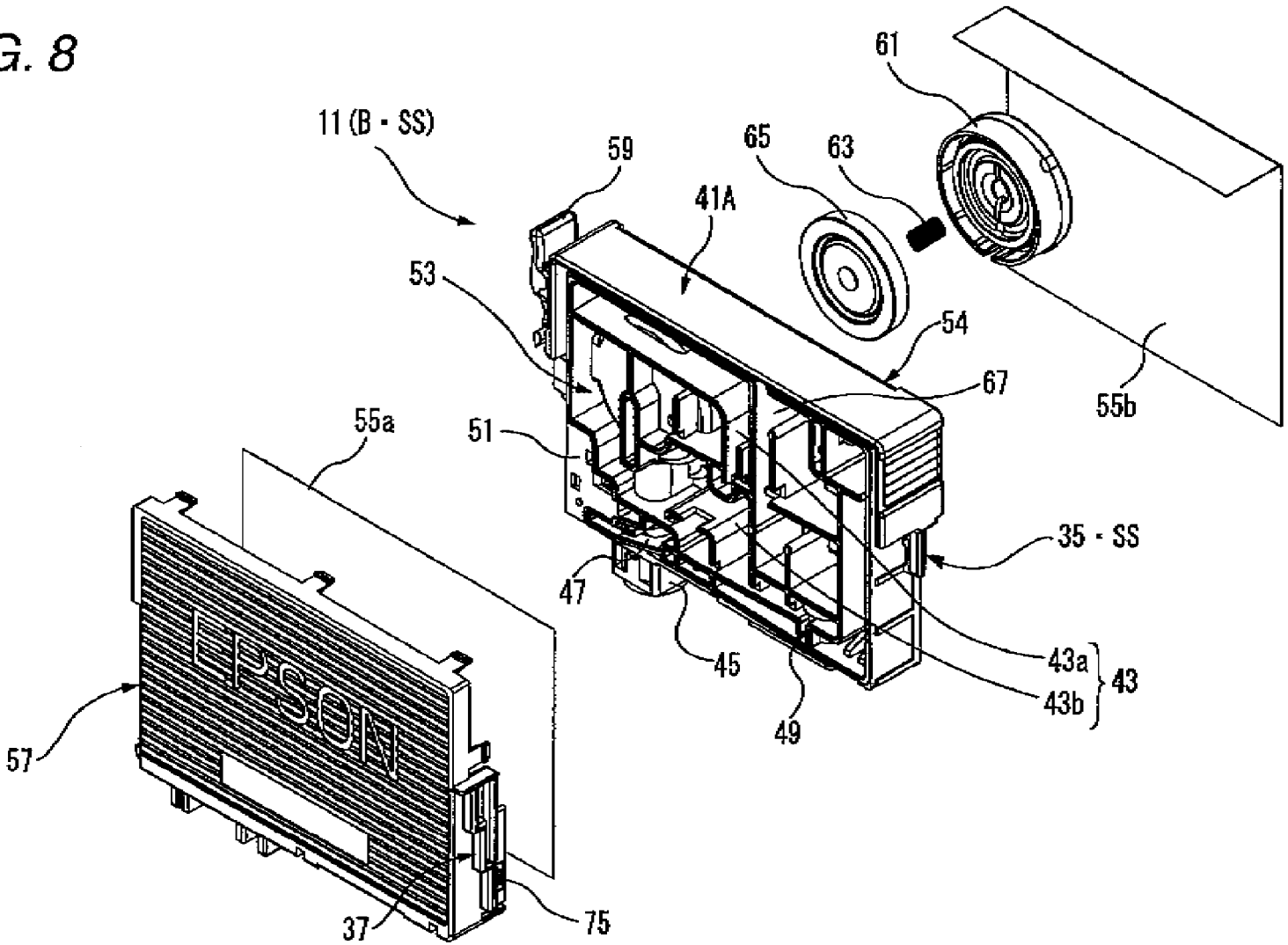
FIG. 8 is an exploded perspective view of a small-capacity liquid container.

FIG. 1 is an exterior perspective view of a liquid ejection apparatus on which a liquid container according to an embodiment of the invention is mounted. FIG., 2 is a plan view of a carriage shown in FIG. 1. FIG. 3 is a cross-sectional view taken along the line III-III of FIG. 2. FIG. 4 is a rear view of an ink cartridge shown in FIG. 3. FIG. 5 is a perspective view showing a state where only one ink cartridge is mounted on a carriage shown in FIG. 1. FIGS. 6A and 6B are perspective views of liquid containers having different capacities. FIG. 7 is an exploded perspective view of a large-capacity liquid container. FIG. 8 is an exploded perspective view of a small-capacity liquid container.

A color ink jet type printer (liquid ejection apparatus) 13 on which ink cartridges (liquid containers) 11 according to this embodiment are mounted includes a paper feed motor 17 that feeds a recording paper 15 in a paper transport direction Y, a platen 19, a carriage 23 on which a printing head (liquid ejecting head) 21 is mounted, and a carriage motor 25 that reciprocates the carriage 23 in a paper widthwise direction X.

The carriage 23 is pulled by a pulling belt 27 that is driven by the carriage motor 25 and moves along a guide rail 29. On the carriage 23, an ink cartridge B for black as an ink cartridge, which contains black ink to be supplied to the printing head 21 and ink cartridges C, M, Y, LC, and LM for color as ink cartridges, which contain color ink (liquid) to be supplied to the printing head 21, are mounted.

Figure 2:
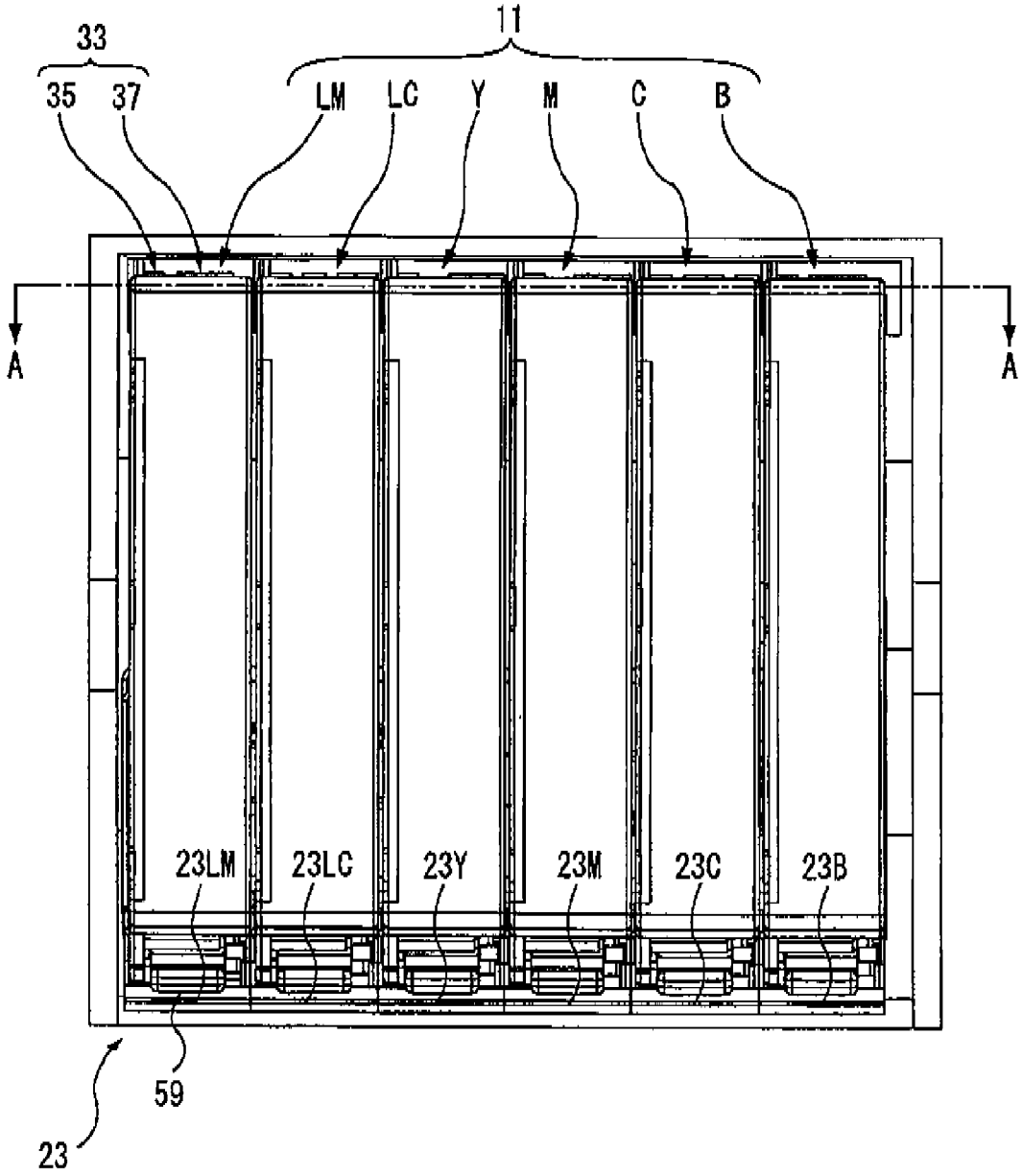
FIG. 2 is a plan view of a carriage shown in FIG. 1.
Figure 3:
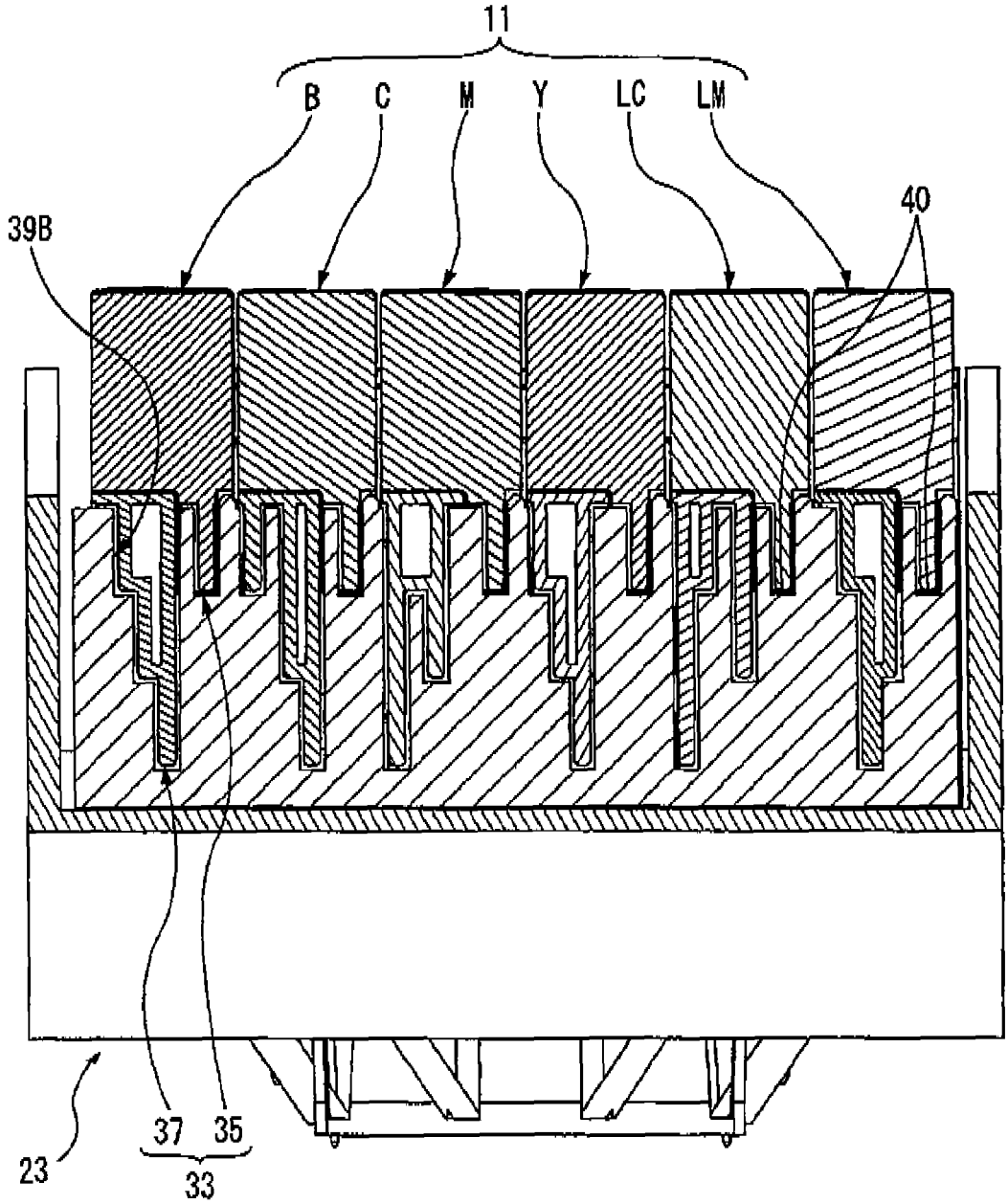
FIG. 3 is a cross-sectional view taken along the line III-III of FIG. 2.

As shown in FIGS. 2 and 3, in this embodiment, as the ink cartridges 11, the ink cartridges B, C, M, Y, LC, and LM are mounted on a plurality of cartridge mounting portions (container mounting portions) 23B, 23C, 23M, 23Y, 23LC, and 23LM, which are formed in the carriage 23, An erroneous insertion prevention mechanism 33 is provided in each of the ink cartridges 11. The erroneous insertion prevention mechanisms 33 prevent the ink cartridges 11 from being erroneously inserted into the cartridge mounting portions 23B, 23C, 23M, 23Y, 23LC, and 23LM, respectively.

As shown in FIG. 4, in each of the ink cartridges 11 of this embodiment, the erroneous insertion prevention mechanism 33 has a conformity identification protrusion 35 (second identification member) that has a shape corresponding to an ink capacity (liquid capacity), and a conformity identification protrusion 37 (first identification member) that has a shape corresponding to the ink kind (liquid kind).

As shown in FIG. 5, the conformity identification protrusion 35 and the conformity identification protrusion 37 are fitted into a corresponding one of conformity grooves 39B, 39C, 39M, 39Y, 39LC, and 39LM that are formed at an internal rear wall of the carriage 23 to correspond to the ink cartridges B, C, M, Y, LC, and LM as the ink cartridges 11 and to have specified shapes.

Meanwhile, the ink cartridges 11 substantially may have the same exterior but different ink capacities. As shown in FIG. 6, in respect to the ink cartridges of the same color, for example, Y (yellow), there are a large ink capacity type ink cartridge B·S and a small ink capacity type ink cartridge B·SS.

Here, the schematic configuration of each of the ink cartridges 11 will be described.

As shown in FIG. 7, each of the ink cartridges 11 includes, in a container main body 41, a liquid containing portion 43 that has an upper storage portion 43*a* and a lower storage portion 43*b* for storing ink, an ink supply portion 45 that is connected to the printing head 21, an ink guide path 47 that guides ink stored in the liquid containing portion 43 to the ink supply portion 45, and an atmosphere communicating port 49 that introduces atmosphere from the outside to the liquid containing portion 43 as ink in the liquid containing portion 43 is consumed.

In this embodiment, an ink end sensor 51 is provided at a position of the ink guide path 47 near the ink supply portion 45. The ink end sensor 51 detects a flow of gas into the ink guide path 47 and then detects that an ink residual quantity of the ink containing portion 43 becomes zero.

A film 55*a* is adhered onto an opening 53 formed at a front surface of the container main body 41, and a film 55*b* is adhered onto an opening 54 of a rear surface thereof. The films 55*a* and 55*b* closes the openings 53 and 54 at the front and rear surfaces of the container main body 41 to form the liquid containing portion 43 and the ink guide path 47. Further, a cover member 57 is fixed to the front surface of the container main body 41 that is sealed with the film 55*a*.

Moreover, in the ink cartridges 11 of this embodiment, levers 59 are respectively provided to attach or detach the ink cartridges 11 to and from the cartridge mounting portions 23B, 23C, 23M, 23Y, 23LC, and 23LM on the carriage 23. Further, each of the ink cartridges 11 is provided with a pressure adjustment mechanism that includes a pressure-receiving plate accommodating portion 61, a coil spring 63, and a pressure-receiving plate 65.

In respect to the container main body 41 that is a first member for forming the liquid containing portion 43 of the ink cartridge 11, a container main body 41A, the volume of a tank volume of which varies according to an ink capacity, is generally used. That is, as shown in FIG. 8, in the container main body 41A that is used for the ink cartridge B·SS having a small ink capacity, parts of the upper storage portion 43*a* and the lower storage portion 43*b* are partitioned by a partition wall 67, thereby forming a small-capacity ink cartridge.

The reason is as follows. If only 5 ml ink is filled into a container main body 41 into which 10 ml ink is to be filled, a large amount of air exists in the upper storage portion 43*a* and the lower storage portion 43*b*. Then, a large amount of air may be dissolved into ink due to vibration upon transportation. Accordingly, a degree of deaeration may be degraded, which may adversely affect printing reliability.

In each of the ink cartridges 11 of this embodiment, the conformity identification protrusion 35 that has a shape corresponding to an ink capacity is integrally formed in the container main body 41 as a first member. Further, the conformity identification protrusion 37 that has a shape corresponding to the ink kind is integrally formed in the cover member 57 as a second member.

As such, if the shape (conformity identification protrusion 35) corresponding to the ink capacity is integrally formed in a part forming the liquid container 43, the number of kinds of the cover member 57 as the second member may correspond to the number of colors. In such a manner, if the shape corresponding to the ink capacity is provided in the container main body 41, and the shape corresponding to the ink kind is provided, the number of kinds of parts is suppressed to the sum of the number of kinds of liquid capacities and the number of ink kinds (the number of kinds of liquid capacities+ the number of liquid kinds). As a result, manufacturing costs of molds or management costs of parts can be reduced.

In this embodiment, as shown in FIG. 4, the conformity identification protrusion 35 and the conformity identification protrusion 37 are provided at a rear surface 69 as one surface of each of the ink cartridges 11.

That is, the conformity identification protrusion 35 corresponding to the ink capacity and the conformity identification protrusion 37 corresponding to the ink kind are put together and arranged at the rear surface 69. Accordingly, the structures of the ink cartridges 11 themselves and the structures of the erroneous insertion prevention shapes (that is, the conformity grooves 39B, 39C, 39M, 39Y, 39LC, and 39LM) in the cartridge mounting portions 23B, 23C, 23M, 23Y, 23LC, and 23LM can be reduced in size and simplified, compared with a case where the shapes thereof are scattered at a plurality of surfaces of each of the ink cartridges 11.

In each of the cartridge mounting portions 23B, 23C, 23M, 23Y, 23LC, and 231M, as shown in FIG. 5, a guide mechanism 73 that guides a corresponding one of the ink cartridges 11 upon mounting is provided at a partition wall 71 that is close to the rear surface 69 of the corresponding ink cartridge 11.

Accordingly, prior to detecting erroneous insertion by the erroneous insertion prevention mechanism 33, the corresponding ink cartridge 11 can be guided to one of the cartridge mounting portions 23B, 23C, 23M, 23Y, 23LC, and 23LM, and erroneous insertion can be prevented over adjacent cartridge mounting portions 23B, 23C, 23M, 23Y, 23LC, and 23LM. Therefore, an erroneous insertion prevention operation by the erroneous insertion prevention mechanism 33 can be reliably exhibited.

That is, on an assumption that the erroneous insertion prevention mechanism 33 exists, if the guide mechanism 73 is not provided, an error of an insertion posture, that is, an error of an insertion position cannot be easily recognized when insertion is performed in an irregular posture. Then, insertion may be interrupted in spite of a regular insertion position. According to the configuration of the guide mechanism 73 of this embodiment, this situation can be prevented.

At the rear surface 69 of each of the ink cartridges 11 according to this embodiment, a mark corresponding to the ink kind is integrally molded in the lid member 57.

Accordingly, if the mark 75 corresponding to the ink kind is granted simultaneously with assembling of each of the ink cartridges 11, a work that grants the mark 75 later can be omitted, thereby realizing work saving. In addition, erroneous display can be reliably prevented.

Further, an assembling worker can easily identify, through the mark 75, the ink kind that is rarely grasped only with the shape of the conformity identification protrusion 37 corresponding to the ink kind. Therefore, erroneous assembling can be reliably prevented.

Moreover, the mark corresponding to the ink capacity can also be integrally molded in the container main body 41. In this case, the mark corresponding to the ink capacity depends on the structure of a resin case (container main body 41) as the first member, that is, the volume. Accordingly, when the mark corresponding to the ink capacity is granted by molding simultaneously with molding of the container main body 41, a work that grants a mark later can be omitted, thereby realizing work saving. In addition, erroneous display can be reliably prevented.

Further, an assembling worker can easily identify, through the mark 75, the ink capacity that is rarely grasped only with the shape corresponding to the ink capacity, that is, the shape of the conformity identification protrusion 35. Therefore, erroneous assembling can be reliably prevented.

Moreover the container main body 41 is a resin case having a substantially rectangular parallelepiped shape. The opening 53 is formed at the surface of the container main body 41. The opening 53 is sealed by the film 55*a*, thereby forming an ink storage chamber (liquid containing portion) 43. Further, the cover member 57 is a film protection member that covers the entire surface of the film 55*a*.

Figure 9:
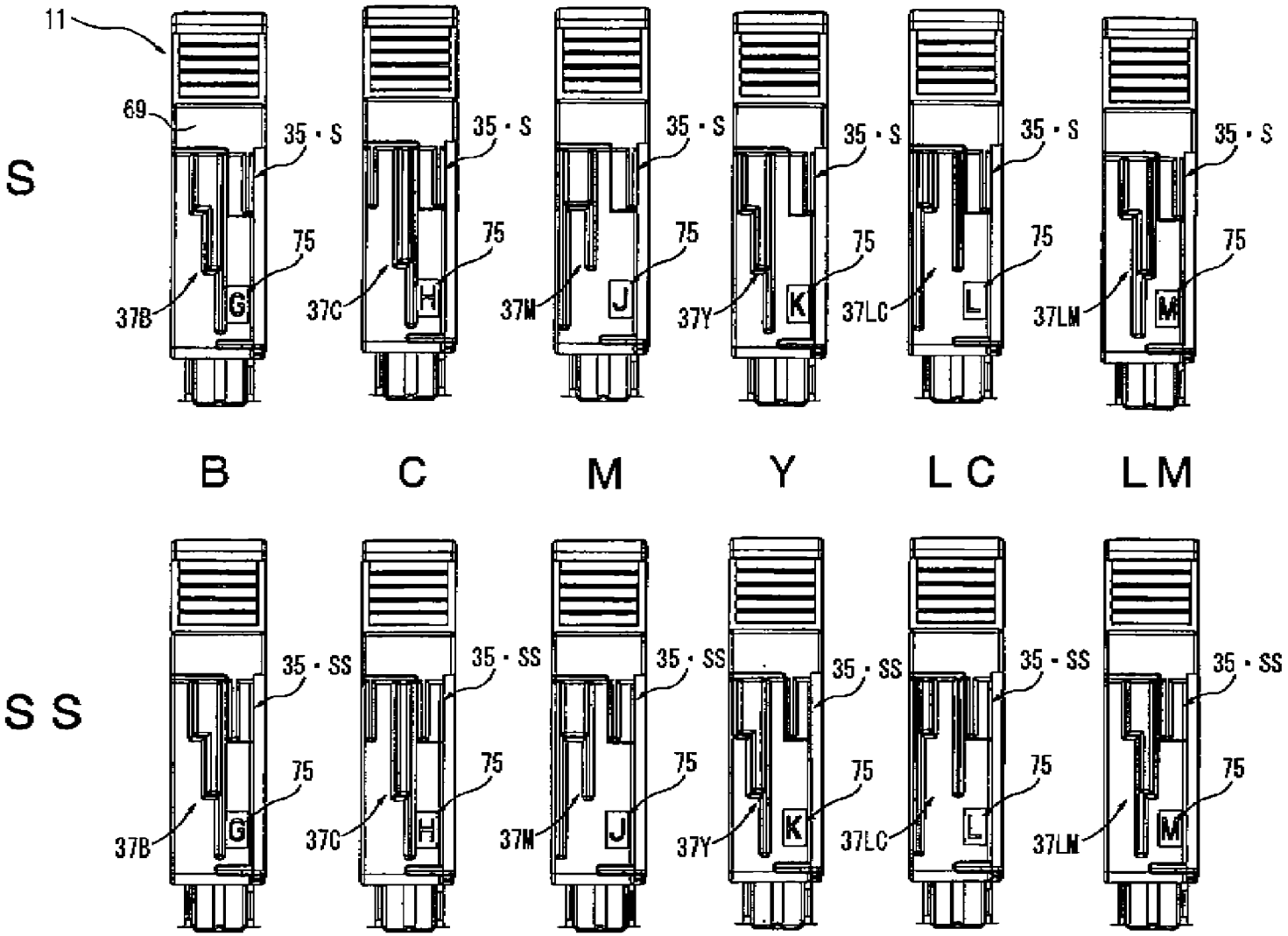
FIG. 9 is a rear view showing the erroneous insertion prevention mechanisms that are provided in the ink cartridges on the basis of capacities and colors.

FIG. 9 is a rear view showing the erroneous insertion prevention mechanisms that are provided in the ink cartridges 11 on the basis of capacities and colors.

In the ink cartridges 11 of this embodiment, as shown in FIG. 9, a conformity identification protrusion 35 that has a shape corresponding to the ink capacity is provided in the container main body 41. As can be seen in FIG. 9, the position of the conformity identification protrusion 35 may vary based upon the ink capacity. Meanwhile, a conformity identification protrusion 37 that has a shape corresponding to the ink kind is provided in the cover member 57.

Accordingly, 12 ink cartridges 11 in total that are divided on the basis of two ink capacities and six ink kinds can be manufactured by a small number of molds of two kinds of molds of the container main body 41 and six kinds of molds of the cover member 57.

The conformity identification protrusions 37 corresponding to the ink kinds are integrally formed at the rear surface 69 of the cover member 57 as a single member. Erroneous insertion is prevented according to a difference in shape of a plurality of conformity identification protrusions 37 that are provided in parallel in an insertion direction.

As shown in FIG. 4, the conformity identification protrusions 37 have different lengths from contact portions located at one end in the insertion direction to a reference surface located at the other end in the insertion direction.

In the conformity identification protrusions 37*a*, 37*b*, 37*c*, and 37*d*, lengths L2, L1, L3, and L0 from the contact portions 37*at*, 37*bt*, 37*ct*, and 37*dt* located at one end in the insertion direction to the reference surface 77 located at the other end in the insertion direction are different. Accordingly, a large number of completely incompatible patterns can be formed in a small space with easy design and simple structure, without enlarging and complicating the structures of the conformity identification protrusions 37 in the erroneous insertion prevention mechanism 33.

Accordingly, the ink cartridges B, C, M, Y, LC, and LM, each of which has the conformity identification protrusions 37*a*, 37*b*, 37*c*, and 37*d* having different lengths L2, L1, L3, and L0 in the erroneous insertion prevention mechanism 33, can be fitted into only the corresponding cartridge mounting portions 23B, 23C, 23M, 23Y, 23LC, and 23LM. That is, completely incompatible erroneous insertion can be easily performed. Therefore, manufacturing costs can be reduced.

Further, the conformity identification protrusions 37*a*, 37*b*, 37*c*, and 37*d* are arranged at regular pitches P in a widthwise direction perpendicular to the insertion direction. Since the conformity identification protrusions 37*a*, 37*b*, 37*c*, and 37*d* are arranged at regular pitches P in a widthwise direction perpendicular to the insertion direction, the conformity identification protrusions 37*a*, 37*b*, 37*c*, and 37*d* can be formed to have the same width even in a small space. Then, uniform manufacturing accuracy can be achieved.

As a result, degradation of manufacturing accuracy when the width of an arbitrary conformity identification protrusion is increased while the width of another conformity identification protrusion is decreased, that is, degradation of erroneous insertion detection accuracy can be prevented.

When the width of any conformity identification protrusion is set to a minimum value required for securing hardness, if other conformity identification protrusions are formed to have the same width, the patterns can be formed a requisite minimum space.

Since the conformity identification protrusions are arranged at the regular pitches, the shapes can be simplified and useless complication can be avoided.

As shown in FIG. 4, the difference in the lengths L2, L1, L3, and L0 of the conformity identification protrusions 37*a*, 37*b*, 37*c*, and 37*d* has a regular pitch.

Figure 10:
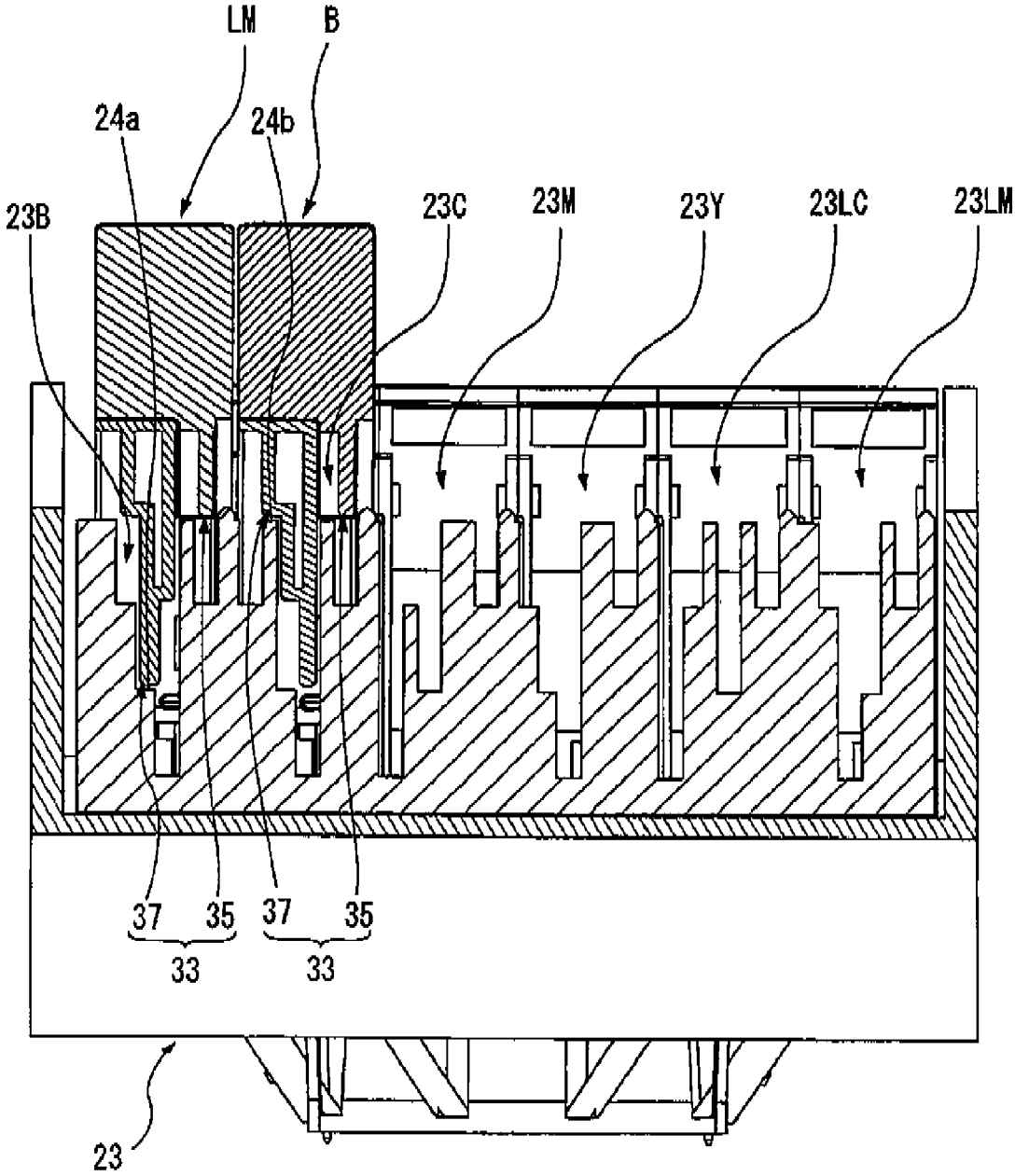
FIG. 10 is a cross-sectional view showing a state where the ink cartridge LM is erroneously inserted into the cartridge mounting portion 23B as the mounting position of the ink cartridge B, and the ink cartridge B is erroneously inserted into the cartridge mounting portion 23C as the mounting position of the ink cartridge C.

FIG. 10 is a cross-sectional view showing a state where the ink cartridge LM is erroneously inserted into the cartridge mounting portion 23B as the mounting position of the ink cartridge B, and the ink cartridge B is erroneously inserted into the cartridge mounting portion 23C as the mounting position of the ink cartridge C.

In the ink cartridge LM, the longest conformity identification protrusion 37 comes into contact with a contact surface 24*a*of the cartridge mounting portion 23B, such that erroneous insertion is prevented. At this time, in FIG. 4, a distance from the regular mounting position is w2.

In the ink cartridge B, the shortest conformity identification protrusion 37 comes into contact with a contact surface 24*b* of the cartridge mounting portion 23C, such that erroneous insertion is prevented. At this time, in FIG. 4, a distance from the regular mounting position is L1.

As such, if the relationship L1=w1=w2 is established, when an erroneous ink cartridge is inserted at the mounting position, a position where the liquid container cannot be inserted due to unconformity of the conformity identification protrusions can be made uniform. The distance L1 is set to such a value that a user can recognize erroneous insertion.

Since the conformity identification protrusions are arranged at the regular pitches, the shapes can be simplified and useless complication can be avoided.

Further, according to the ink cartridges 11 of this embodiment, the shape of the conformity identification protrusion 35 corresponding to the ink capacity is integrally provided in the container main body 41 as the first member. Meanwhile, the shape of the conformity identification protrusion 37 corresponding to the ink kind is provided in the cover member 57 as the second member that is separated from the container main body 41. Accordingly, the number of kinds of parts can be set to the sum of the number of kinds of ink capacities and the number of ink kinds. Therefore, the number of kinds of parts can be reduced, and thus manufacturing costs of the molds or management costs of the parts can be reduced.

As a result, the completely incompatible erroneous insertion prevention mechanism 33 can be formed with a small number of parts, and thus manufacturing costs of the ink cartridges 11 can be reduced.

In addition, according to the ink cartridges 11 of this embodiment, in the ink cartridge B and the ink cartridge Y, the conformity identification protrusions 37 have the same shape when they are shifted by one pitch. However, a concave portion 38 (see FIG. 6) of the ink cartridge B is fitted to the guide mechanism 73 (see FIG. 5) of the cartridge mounting portion 23Y and then guided before erroneous insertion identification. Accordingly, the ink cartridge B can be prevented from being erroneously inserted into the cartridge mounting portion 23Y in a state where it is shifted by one pitch to the left.

Further, a capacity judgment groove 50 shown in FIGS. 3 and 5 has a shape corresponding to the S type ink cartridge 11 having a large ink capacity. Alternatively, a groove maybe formed to have a shape corresponding to the SS type or both the S type and the SS type with simple configuration.

In the embodiment, although the erroneous insertion is prevented by the conformity identification protrusion 35 and the conformity identification protrusions 37 provided in the ink cartridge 11 and the conformity grooves 39 provided in the printer 13, the present invention is not limited to this configuration. That is, conformity identification protrusions may be provided in a printer and conformity identification grooves may be provided in an ink cartridge.

What is claimed is:

1. A liquid container for containing a liquid, which is detachably mountable on a liquid ejection apparatus, the liquid container comprising:

a first member, a second member attached with the first member, a surface parallel to an insertion direction into the liquid ejection apparatus; and a plurality of conformity identification protrusions integrally formed at the surface to be in parallel to the insertion direction for preventing erroneous insertion of the liquid container to a container mounting portion due to a difference in shape of the conformity identification protrusions, wherein the conformity identification protrusions include a first part corresponding to a capacity of the liquid and a second part corresponding to a kind of the liquid, the first part is provided on the first member, the second part is provided on the second member, each of the conformity identification protrusions in the first part is provided at a position varied with the capacity of the liquid, and each of the conformity identification protrusions in the second part has a different length from a contact portion located at one end in the insertion direction to a reference surface located at the other end in the insertion direction.

2. The liquid container according to claim 1, wherein the conformity identification protrusions are arranged at a regular pitch in a widthwise direction perpendicular to the insertion direction.

3. The liquid container according to claim 1, wherein the difference in the lengths of the conformity identification protrusions has a regular pitch.

4. The liquid container according to claim 1, wherein a mark that corresponds to the difference in shape of the conformity identification protrusions is integrally molded at the surface.

5. A liquid container for containing a liquid, which is detachably mountable on a liquid ejection apparatus, the liquid container comprising:

a first member, a second member attached with the first member, a surface parallel to an insertion direction into the liquid ejection apparatus;

a plurality of first identification members provided on the first member and integrally formed at the surface for preventing erroneous insertion of the liquid container to a container mounting portion due to a difference in shape of the first identification members, and a second identification member provided on the second member and integrally formed at the surface for preventing erroneous insertion of the liquid container to the container mounting portion due to a difference in shape of the second identification member, wherein each of the second identification members has a different length from a contact portion located at one end in the insertion direction to a reference surface located at the other end in the insertion direction; and the first identification member is a groove recessed from the surface, the first identification members correspond to a capacity of the liquid, each of the first identification members is provided at a position varied with the capacity of the liquid, and the second identification member corresponds to a kind of the liquid.

6. The liquid container according to claim 5, wherein the first identification members are arranged at a regular pitch in a widthwise direction perpendicular to the insertion direction.

7. The liquid container according to claim 5, wherein the difference in the lengths of the first identification members has a regular pitch.

8. The liquid container according to claim 5, wherein a mark that corresponds to the difference in shape of the first identification members is integrally molded at the surface.

* * * * *